United States Patent [19]

Krubski

[11] 4,071,144

[45] Jan. 31, 1978

[54] DISPLAY FOR KNIVES

[75] Inventor: George Krubski, Jersey City, N.J.

[73] Assignee: Cooper Industries, Inc., Houston, Tex.

[21] Appl. No.: 705,394

[22] Filed: July 15, 1976

[51] Int. Cl.[2] ..... A47F 7/00

[52] U.S. Cl. ..... 211/13; 206/477; 211/89

[58] Field of Search ..... 211/13, 60 R, 60 T, 211/89; 206/477, 480, 483, 495, 44.11; 248/37.3, DIG. 3, 226.5

[56] References Cited

U.S. PATENT DOCUMENTS

| | | | |
|---|---|---|---|
| 912,094 | 2/1909 | Durkee | 206/44.11 X |
| 1,501,629 | 7/1924 | Smith | 211/89 X |
| 1,704,514 | 3/1929 | Ramsey | 206/480 |
| 1,719,681 | 7/1929 | Wiebusch | 206/44.11 X |
| 2,027,799 | 1/1936 | Wharton | 211/13 |
| 2,296,506 | 9/1942 | Docker | 211/13 |
| 2,316,290 | 4/1943 | Schenbeck | 211/89 UX |
| 2,937,758 | 5/1960 | Tabb | 211/89 X |
| 3,237,898 | 3/1966 | Goss | 248/DIG. 3 |

*Primary Examiner*—Marion Parsons, Jr.
*Assistant Examiner*—Robert W. Gibson, Jr.
*Attorney, Agent, or Firm*—Jacobs & Jacobs

[57] ABSTRACT

A display panel for pocket knives or the like has a plurality of knife holders mounted on a base, the knives being held in place by U-shaped clips that have one leg in the knife and the other between the holder and the base.

5 Claims, 3 Drawing Figures

DISPLAY FOR KNIVES

The present invention relates to a method and apparatus for displaying pocket knives or similar goods.

In the past, pocket knives have been displayed for sale by mounting the knives on a panel by means of wires or the like, with the blades fully or partially opened, or by setting the knives into recesses in a plastic panel. The use of wires or the like is inconvenient because of the time needed to assemble a full display of the goods. As a practical matter, this means that when a knife is removed from the display panel, it will seldom be replaced by the retailer due to the time and effort required. The use of molded panels is expensive and does not lend itself to substituting one knife for another. Thus, the molded panels are designed so that the recesses will fit essentially only the knife designed for the recess.

It is thus an object of the invention to provide a display panel that can accommodate a wide variety of knives.

It is another object of the invention to provide a display panel where the knives can be placed on the display in a simple, rapid manner.

It is a further object of the invention to provide a display panel that will permit simple and rapid substitution of one knife for another.

These objects are fulfilled by the present invention, which provides a display panel which comprises a base, a plurality of elongated holder means mounted on a surface of the base, each holder means having a back member and a flange member extending transversely thereto for supporting an object to be displayed, the back member of each holder means being spaced from the base to form a pocket between the back member and the base, and a plurality of U-shaped clip means proportioned such that the legs thereof will straddle the back member of a holder means when one leg is inserted in a pocket of a holder means, the object to be displayed being secured to the holder means by engagement with the other leg of said clip means.

The present invention is illustrated by the accompanying drawing, in which.

Figure 1:
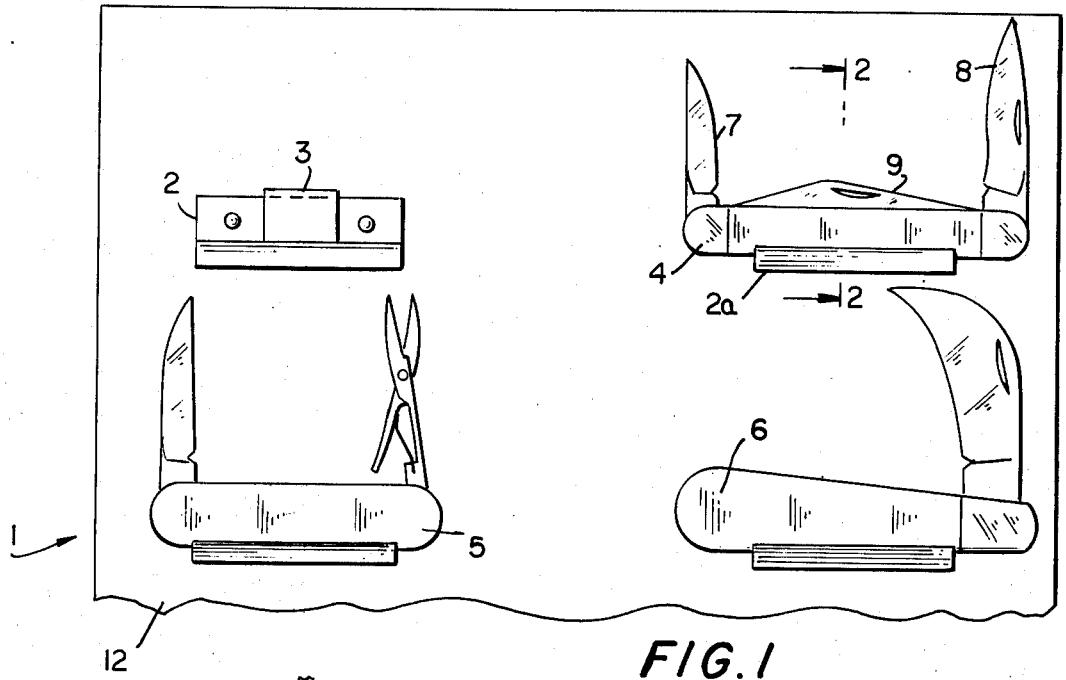
FIG. 1 is a plan view of a display panel showing several knives in place.

Referring to FIG. 1, the display panel 1 carries a plurality of holders or supports 2 and clips 3 for securely mounting a variety of knives of widely differing shapes and sizes. In so doing, all of the knives in stock can be displayed at one time. As can be seen, the knives 4, 5 and 6 are of different sizes and configuration, and yet all are readily displayed on the panel 1 by the same holder 2 and clip 3.

Figure 2:
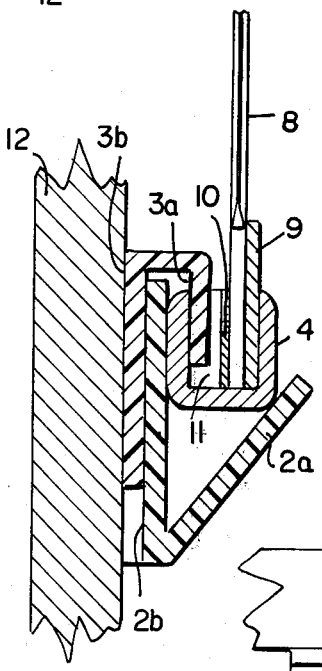
FIG. 2 is a view in section along lines 2—2 of FIG. 1.
Figure 3:
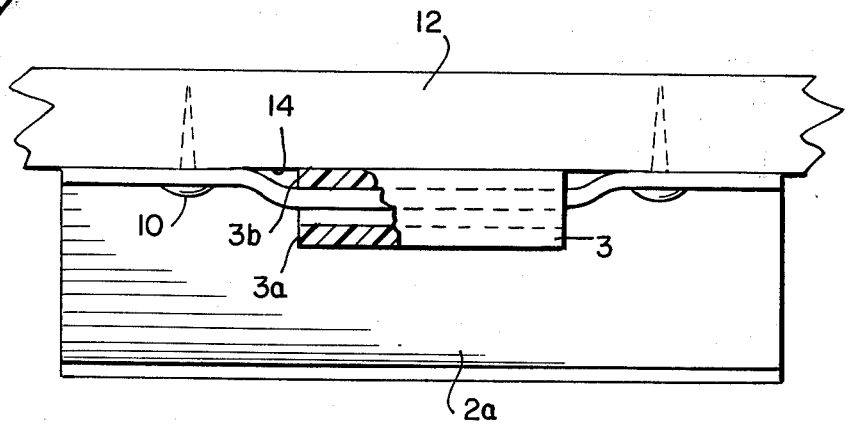
FIG. 3 is an enlarged detailed view of a knife holder.

Each knife 4, 5 and 6 rests on the flange 2*a* of support 2 and is held in place by clip 3. As can be seen in FIG. 2, the knife 4 has a divider 10 such that blades 8 and 9 fall on one side of the divider 10 and blade 7 falls into the aperture 11 on the other side. Leg 3*a* of the clip 3 fits into aperture 11 while leg 3*b* slides between the back 2*b* of support 2 and the backing 12 of the panel 1 (FIG. 3). Preferably, clip 3 is a spring clip and legs 3*a* and 3*b* are biased toward each other. The supports 2 are held in place by means of fasteners 13 extending through the back 2*b* into the base 12.

In a similar manner, knives 5 and 6 are similarly held in place on their respective supports 2.

Any rigid, non-brittle plastics material may be used to form the support 2 and clip 3, such as polyethylene, polypropylene, ABS, PVC, and the like. The base 12 may be of wood or similar material that will allow the holders 2 to be fastened thereto.

It can readily be seen that a knife may be removed from the panel merely by sliding the knife and its associated clip 3 upwardly so that the leg 3*b* slides out of the pocket 14 formed between the base 12 and the back 2*b*. A totally different knife can be replaced, using the same clip 3 that was holding the knife in place.

To form the display, a plurality of the supports 2 are fastened in place, with the back 2*b* of the support 2 being bowed when it is fastened to the panel so as to form the pocket 14.

While the present invention has been described in terms of displaying pocket knives, other objects can be displayed so long as they can fit between leg 3*a* and back 2*b*. For example, screw drivers, wrenches and other tools can be displayed. In addition, while the holders 2 and clips 3 have been shown all to be of the same size, it is within the scope of this invention to provide the display panel with holders of the same size and clips of a variety of sizes or with holders of different sizes and clips that are either of the same size or of a variety of sizes.

What is claimed is:

1. A display panel which comprises a base, a plurality of elongated rigid plastic holder means fastened to a surface of the base, each rigid non-brittle plastic holder means having a back member and a flange member extending transversely thereto for supporting an object to be displayed, a pair of spaced apart fastener means on said back member fastening each holder means to said base, the portion of each back member of each holder means between said fastener means being spaced from the base to form a pocket between the back member and the base, and a plurality of U-shaped clip means proportioned such that the legs thereof will straddle the back member of a holder means when one leg is inserted in a pocket of a holder means, the object to be displayed being secured to the holder means by engagement with the other leg of said clip means.

2. The display panel according to claim 1, wherein said clips are spring clips.

3. The display panel according to claim 1, wherein the objects are pocket knives having one or more blades folding into an aperture in the knife, said other leg being inserted into said aperture.

4. The display panel according to claim 1, wherein the clip means are made of plastic.

5. The display panel according to claim 1, wherein there are sufficient holder means to display a plurality of different types or sizes of knives.

* * * * *